US007796907B2

(12) United States Patent
Condello

(10) Patent No.: US 7,796,907 B2
(45) Date of Patent: Sep. 14, 2010

(54) METHOD AND APPARATUS FOR DETECTING AND AVOIDING A DEFECT ON A FUSER WEB

(75) Inventor: Anthony Salvatore Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 416 days.

(21) Appl. No.: 11/962,566

(22) Filed: Dec. 21, 2007

(65) Prior Publication Data

US 2009/0196642 A1 Aug. 6, 2009

(51) Int. Cl.
*G03G 15/20* (2006.01)

(52) U.S. Cl. ..... 399/67; 399/122; 399/129

(58) Field of Classification Search ..... 399/122, 399/329, 67; 219/216
See application file for complete search history.

(56) References Cited

U.S. PATENT DOCUMENTS 4,740,439 A * 4/1988 Tachikawa et al. ..... 430/54
5,162,634 A * 11/1992 Kusaka et al. ..... 219/216
5,173,733 A * 12/1992 Green ..... 399/26
5,191,380 A 3/1993 Hoover et al.
5,200,785 A 4/1993 Hoover et al.
5,749,038 A 5/1998 Fromm et al.
5,839,016 A * 11/1998 Folkins et al. ..... 399/46
6,029,041 A * 2/2000 Takano et al. ..... 399/388
6,298,586 B1 * 10/2001 Todome ..... 399/303
6,505,832 B2 1/2003 Moore et al.
6,795,677 B2 9/2004 Berkes et al.
6,850,721 B2 2/2005 Repole
6,868,251 B2 3/2005 Pirwitz
2002/0039504 A1 * 4/2002 Nakayama et al. ..... 399/328
2002/0136565 A1 * 9/2002 Nagatsuna et al. ..... 399/109
2004/0090647 A1 * 5/2004 Beard et al. ..... 358/1.14
2005/0135669 A1 * 6/2005 Cormier et al. ..... 382/152

FOREIGN PATENT DOCUMENTS

JP 08105842 A * 4/1996
JP 2006266934 A * 10/2006
JP 2007206520 A * 8/2007

* cited by examiner

*Primary Examiner*—David M Gray
*Assistant Examiner*—G. M. Hyder
(74) *Attorney, Agent, or Firm*—Ronald E. Prass, Jr.; Prass LLP

(57) ABSTRACT

Disclosed are an electrophotographic apparatus for forming images on sheets, and corresponding methods. The electrophotographic apparatus includes a fuser web for fusing toner particles to the sheets to form the images, a sensor for detecting a defect position of at least one defect in the fuser web, and a controller that receives the defect position of the at least one defect on the fuser web from the sensor, wherein the controller positions the fuser web relative to the sheets to avoid the at least one defect from coming into contact with the toner on the sheets during fusing of the toner particles to the sheets.

20 Claims, 5 Drawing Sheets

METHOD AND APPARATUS FOR DETECTING AND AVOIDING A DEFECT ON A FUSER WEB

CROSS REFERENCE TO RELATED APPLICATION

This application is related to the US application filed simultaneously with this application, the disclosure of which is incorporated by reference herein in its entirety.

BACKGROUND

Disclosed are an electrophotographic apparatus having a web fuser and corresponding methods.

In a typical electrophotographic or electrostatographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited as latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat and pressure, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rollers with the toner image contacting the heated fuser roller to thereby effect heating of the toner images within the nip. In a conventional two roll fuser, one of the rolls is typically provided with a layer or layers that are deformable by a harder opposing roller when the two rollers are pressure engaged.

Web fusers are a type of toner image fixing device in which a web is looped around a fuser roller and typically conveyance rollers. A belt could be used in place of the web, where typically a belt is endless forming a loop, while a web has two ends each of which may be connected to a spool. A pressure roller presses a sheet having a toner image onto the fuser roller with the endless belt intervening between the pressure roller and the fuser roller. The fixing temperature for the toner image is controlled on the basis of the temperature of the fuser roller which may be detected by a sensor, such as a sensor in the loop of the belt and in contact with the fuser roller. A nip region is formed on a pressing portion located between the fuser roller and the pressure roller. The web or a belt fuser is typically short as the fuser assembly is often enclosed within a cassette, and it is desirable that such a fuser cassette is as small as possible.

The primary failure modes of such web fusers which represent the largest contribution to fuser run cost are typically attributed to the life of the fuser web or member. The fuser web comes into contact with the toner during the fusing process, and greatly influences the final quality of the print. Imperfections can form in the web including edgewear, toner offset, scratches, coating defects, and the like. It would be desirable to reduce the onset rate of these failure modes and/or to avoid toner contact with any damaged portion of the web once damage occurs, to increase the life of the web and fuser assembly.

SUMMARY

According to aspects of the embodiments, there is provided an electrophotographic apparatus for forming images on sheets, and corresponding methods. The electrophotographic apparatus includes a fuser web for fusing toner particles to the sheets to form the images, a sensor for detecting a defect position of at least one defect in the fuser web, and a controller that receives the defect position of the at least one defect on the fuser web from the sensor, wherein the controller positions the fuser web relative to the sheets to avoid the at least one defect from coming into contact with the toner on the sheets during fusing of the toner particles to the sheets.

DETAILED DESCRIPTION

Figure 1:
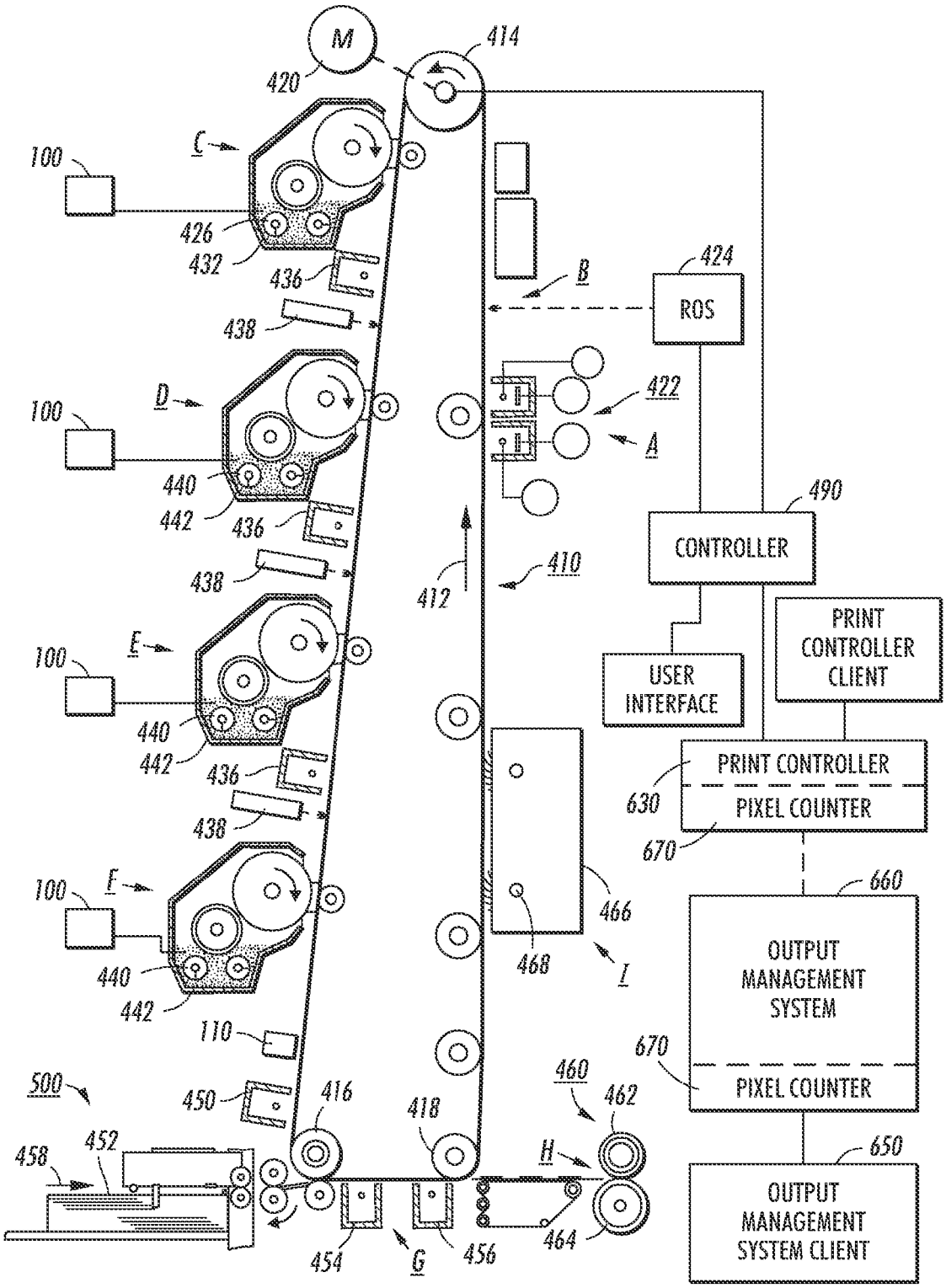
FIG. 1 illustrates a schematic view of a digital imaging system.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The disclosed embodiments include a method of forming images on sheets in an electrophotographic apparatus, the electrophotographic apparatus having a fuser web for fusing toner particles to the sheets to form the images. The method includes detecting a defect position of at least one defect in the fuser web with a sensor, sending the defect position to a controller, the controller also receiving image data for forming the images on the sheets, and controlling a position of the fuser web with respect to the sheets with the controller so that the defects avoid coming into contact with the toner particles on the sheets during fusing of the toner particles to the sheets.

The disclosed embodiments further include an electrophotographic apparatus for forming images on sheets. The electrophotographic apparatus includes an fuser web for fusing toner particles to the sheets to form the images, a sensor for detecting a defect position of at least one defect in the fuser web, and a controller that receives the defect position of the at least one defect on the fuser web from the sensor, wherein the controller positions the fuser web relative to the sheets to avoid the at least one defect from coming into contact with the toner on the sheets during fusing of the toner particles to the sheets.

The disclosed embodiments further include an electrophotographic apparatus for forming images on sheets, the electrophotographic apparatus including a web fuser for fusing toner particles to the sheets to form the images, a sensor for detecting a defect position of at least one defect in the web fuser, a fuser roller which contacts the web fuser at a fusing location, first and second web rollers, the first end of the fuser web being attached to the first web roller and the second end of the fuser web being attached to the second web roller, and a controller that receives the defect position of the at least one defect on the fuser web from the sensor, wherein the controller controls a position of the fuser web relative to the sheets to avoid the at least one defect from coming into contact with the toner on the sheets during fusing of the toner particles to the sheets by: determining positioning of toner particles to be fused to each of the sheets to form the images from image data received by the controller, the images formed on each of the sheets comprising image areas where toner particles are fused and non-image areas where toner particles are not fused, and controlling the position of the at least one defect to be between adjacent ones of the sheets as the adjacent sheets are brought into contact with the web fuser or to be in non-image areas of the images on the sheets as the sheets are brought into contact with the web fuser.

In as much as the art of electrophotographic printing is well known, the various processing stations employed in the FIG. 1 printing machine will be shown hereinafter schematically and their operation described briefly with reference thereto. Various other printing machines could also be used, and this is only an example of a particular printing machine that may be used with the invention.

FIG. 1 is a partial schematic view of a digital imaging system, such as the digital imaging system of U.S. Pat. No. 6,505,832, which is hereby incorporated by reference. The imaging system is used to produce an image such as a color image output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of photoreceptor belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure which is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor 600 which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and pressure roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator. The fuser assembly 460 may be contained within a cassette, and may include additional elements not shown in this figure, such as an endless fuser belt or fuser web around the fuser roller 462. In typical printing machines, this belt or web has been kept relatively short to minimize the size of the fuser assembly or cassette.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The foregoing description illustrates the general operation of an electrophotographic printing machine incorporating the development apparatus of the present disclosure therein. Not all of the elements discussed in conjunction with FIG. 1 are necessarily needed for effective use of the invention. Instead, these elements are described as a machine within which embodiments of the invention could operate.

Figure 2:
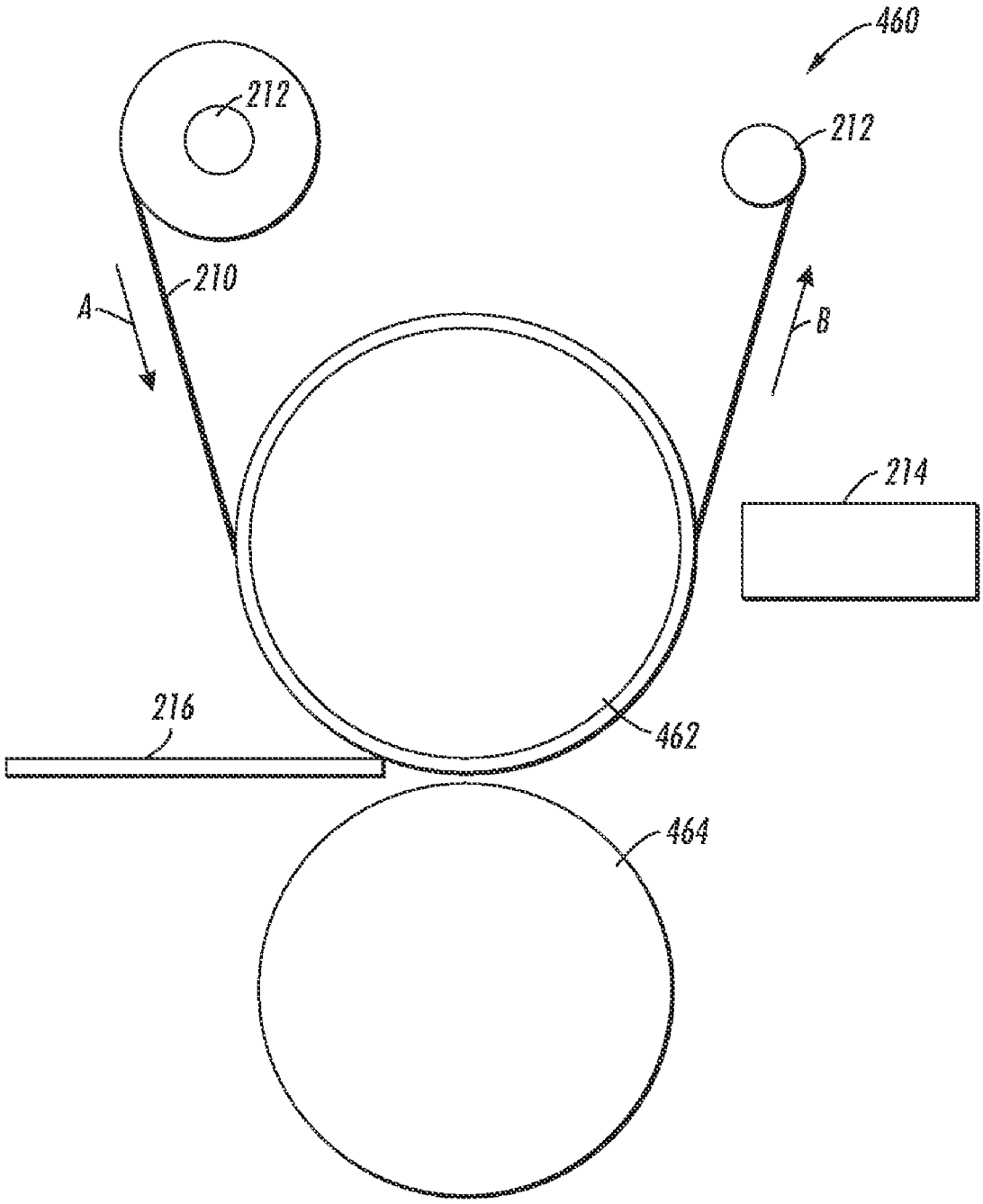
FIG. 2 illustrates a diagram of a fuser assembly in one possible embodiment of the invention.

FIG. 2 illustrates the fuser assembly 460 in greater detail. The fuser assembly 460 includes the fuser roller 462, the pressure roller 464, fuser web 210, web rollers 212, and defect sensor 214. The fuser web 210 may be driven by a motor (not shown) such as a stepper motor, for example. Media sheet 216 may come into contact with fuser web 210 to accomplish the fusing process.

The fuser web 210 is lengthened as compared to the relatively short fuser web typically used. In the embodiment shown in FIG. 2, the longer fuser web 210 has two ends, with each end connected to one of the web rollers 212. In FIG. 2, most of the volume of the fuser web 210 is wound around the leftmost web roller 212. During the fusing process, the fuser web 210 moves in the direction of arrows A and B as the sheet 216 comes into contact with the fuser web 210 and the pressure roller 464. During this process, the fuser web unrolls from the leftmost web roller 212 in FIG. 2, and rolls onto the rightmost web roller 212. By using the web rollers 212, the length of the fuser web 210 can be lengthened while still taking up a relatively compact space. The web rollers may be heated, cooled or heat-pipe like rollers, which may act to mitigate both axial and process direction temperature deltas.

In preferred embodiments, the fuser web 210 may be between 50 m and 100 m in length, although longer webs could be used. Lengthening the fuser web 210 can allow a longer life because defects in the fuser web may be kept out of contact with the image areas to be transferred to any sheet.

The defect sensor 214 is used to sense any defects, imperfections or flaws that may develop in the fuser web 210. These defects may include edgewear, toner offset, scratches, coating defects, chemical breakdown, and the like. Any type of defect sensor 214 that can sense these types of defects, such as an optical sensor, may be used. The defect sensor may detect positions of any defects on the fuser web 210. The detected positions may be sent to the controller 490, or to print controller 630, for example, which may be programmed to control positioning of the fuser web 210 with respect to the sheets 216 to avoid contact of the defects in the fuser web 210 with the sheets 216. The position on the fuser web 210 of a particular defect may be kept track of by using small closely placed markers along an edge or edges of the fuser web 210 and then associating a detected defect with a particular one or ones of the markers, for example. However, any method of keeping track of a position of the defects may be used.

Figure 3:
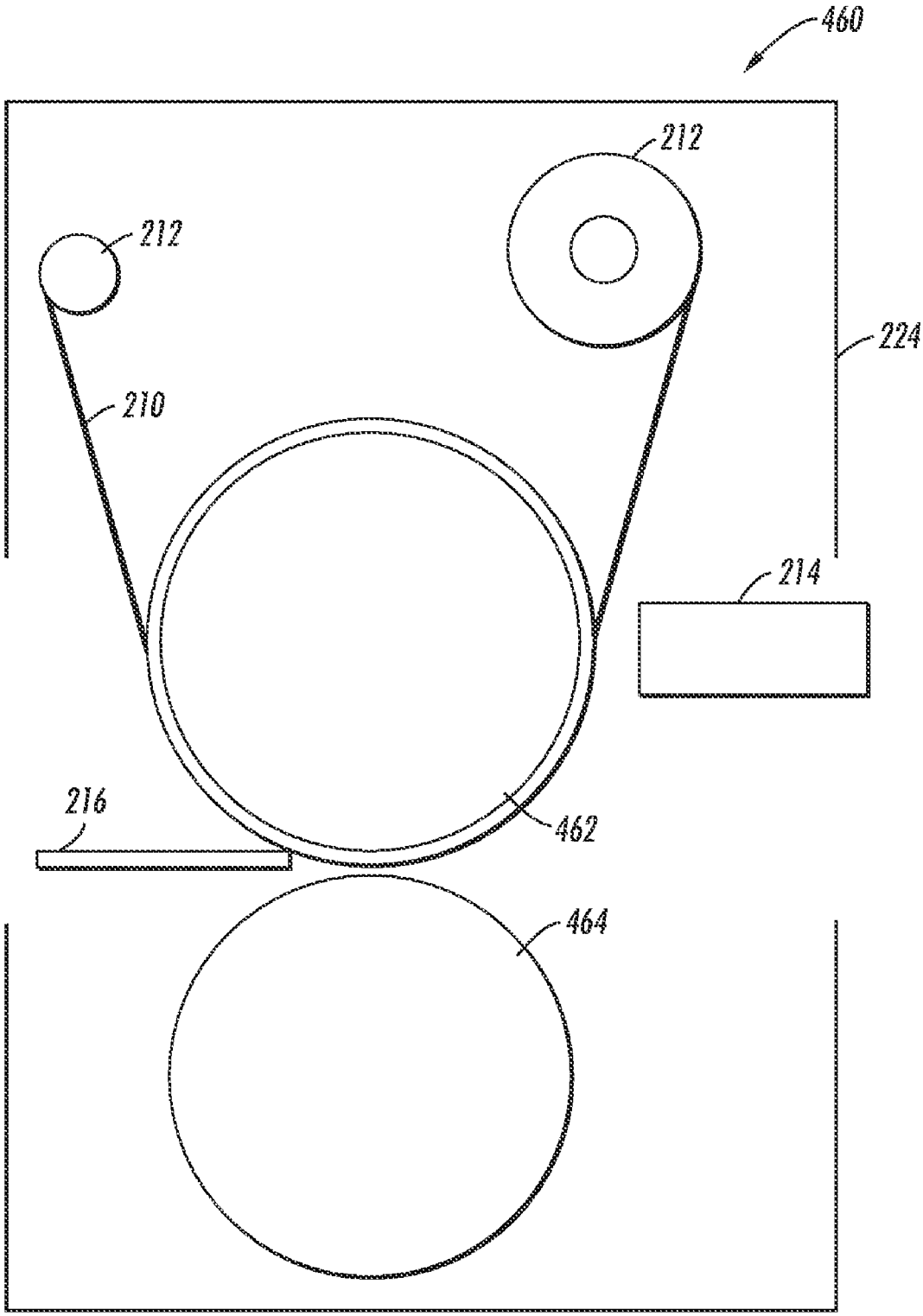
FIG. 3 illustrates a diagram of a fuser assembly which includes a cassette.

FIG. 3 illustrates an embodiment of the of the fuser assembly 460 which includes a cassette 224. The cassette may contain the entire fuser assembly 460, although the sensor 214 may be separate. In FIG. 3, the fuser web 210 is shown where a majority of its length has been rolled onto the rightmost web roller 212. Because the sheet 216 always enters from the left side of the fuser roller 462, the fuser web 210 always moves in the same direction during the fusing process. Further, when all of the fuser web 210 has been unwound from the leftmost web roller 212 in FIG. 3, in embodiments the web 210 may go through a rewinding process, where the fuser web 210 moves in an opposite direction from the direction it moves as shown by directions A and B in FIG. 2, and unwinds from the rightmost web roller 212 in FIG. 3 and winds onto the leftmost fuser roller 212, when the fusing process does not occur.

In FIG. 3, the cassette 224 may also be configured so that it may be "turned over" typically being rotated 180 degrees so that the leftmost web roller 212 and the rightmost web roller 212 as shown in FIG. 3 trade places. In this way, rewinding is not necessary, since the fully wound leftmost web roller 212 as shown in FIG. 3 will then be on the right of the fuser roller 462, ready to continue the fusing process. The cassette 224 could be flipped over manually, or structure could be included to automatically accomplish the flipping. Flipping of the cassette may be quicker than a rewinding of the fuser web 210. The cassette 224 has openings in each side where the sheets 216 can enter and leave, and for insertion of the sensor 214. The openings may be a same size and positioned at a same height on the cassette 224 as shown in FIG. 3 so that when the cassette 224 is flipped the openings are correspondingly positioned.

Figure 4:
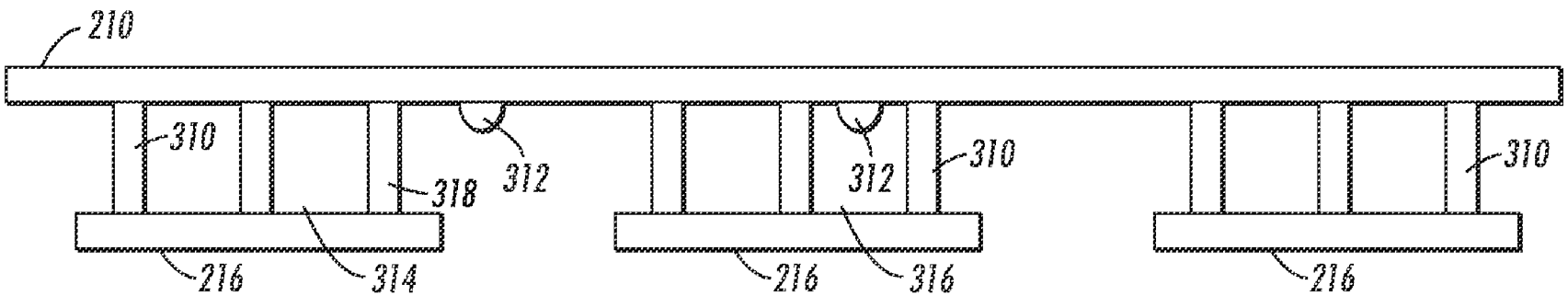
FIG. 4 illustrates a diagram of a web fuser and associated elements.

FIG. 4 illustrates how defects 312 in a fuser web 210 may be positioned by disclosed embodiments to avoid contacting toner particles on sheets 216 or to be placed in non-image areas of sheets 216 as the sheets 216 come into contact with fuser web 210. This avoids the defects 312 from affecting the toner particles that are fused onto the sheet 216 to form the image. FIG. 4 shows the fuser web 210 as flat and coming into contact with more than one sheet 216 at a time for illustration purposes only, as in reality the fuser web 210 curves around the fuser roller, and typically only comes into contact with one sheet 216 at a time.

The position of any defects 312 in the fuser web 210 are determined by defect sensor 214, which information if fed to the controller 490, and which may be stored in an associated memory (not shown). During the fusing process, the controller 490 controls the position of the sheets 216 and/or the fuser web 210 to avoid contact of the defects 312 with the toner particles on the sheets 216. For example, as may be seen with the leftmost defect 312 in FIG. 3, the position of a defect 312 may be controlled to be between sheets 216 as the sheets 216 come into contact with the fuser web 210. In this way, the defects do not interfere with the fusing process.

The digital image data for printing an image on each sheet 216 is communicated to the controller 490. Each image to be printed on a sheet 216 may contain portions with image data, image portions, and portions without any image data, non-image portions. As shown in FIG. 4, the non-image portions 314, 316 are between toner particles 310 that are fused to the sheet 216 in the fusing process. The image portions 318 correspond to portions on a sheet 216 where toner is fused to form an image.

Instead of or in addition to controlling a position of defects 312 to be between the sheets 216 as in the leftmost defect 312 shown in FIG. 4, embodiments may control a position of a defect or defects 312 to be in a non-image portion 314, 316 of an image between or adjacent to image portions 318, such as the rightmost defect 316 in FIG. 4.

By placing the defect or defects in non-image portions of the image to be printed, embodiments avoid having the defects affect the image to be printed and extend a life of the fuser web and/or fuser assembly. In addition, where more than one defect is present, embodiments may use either the method of positioning the defects between sheets or placing defects in non-image areas of the sheets. Further, embodiments may use both of these methods at the same time, where one or more defects are positioned between adjacent sheets and one or more defects are positioned in one or more non-image areas of a sheet.

Embodiments as disclosed herein may include computer-readable medium for carrying or having computer-executable instructions or data structures stored thereon. Such computer-readable medium can be any available medium that can be accessed by a general purpose or special purpose computer. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof) to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

Figure 5:
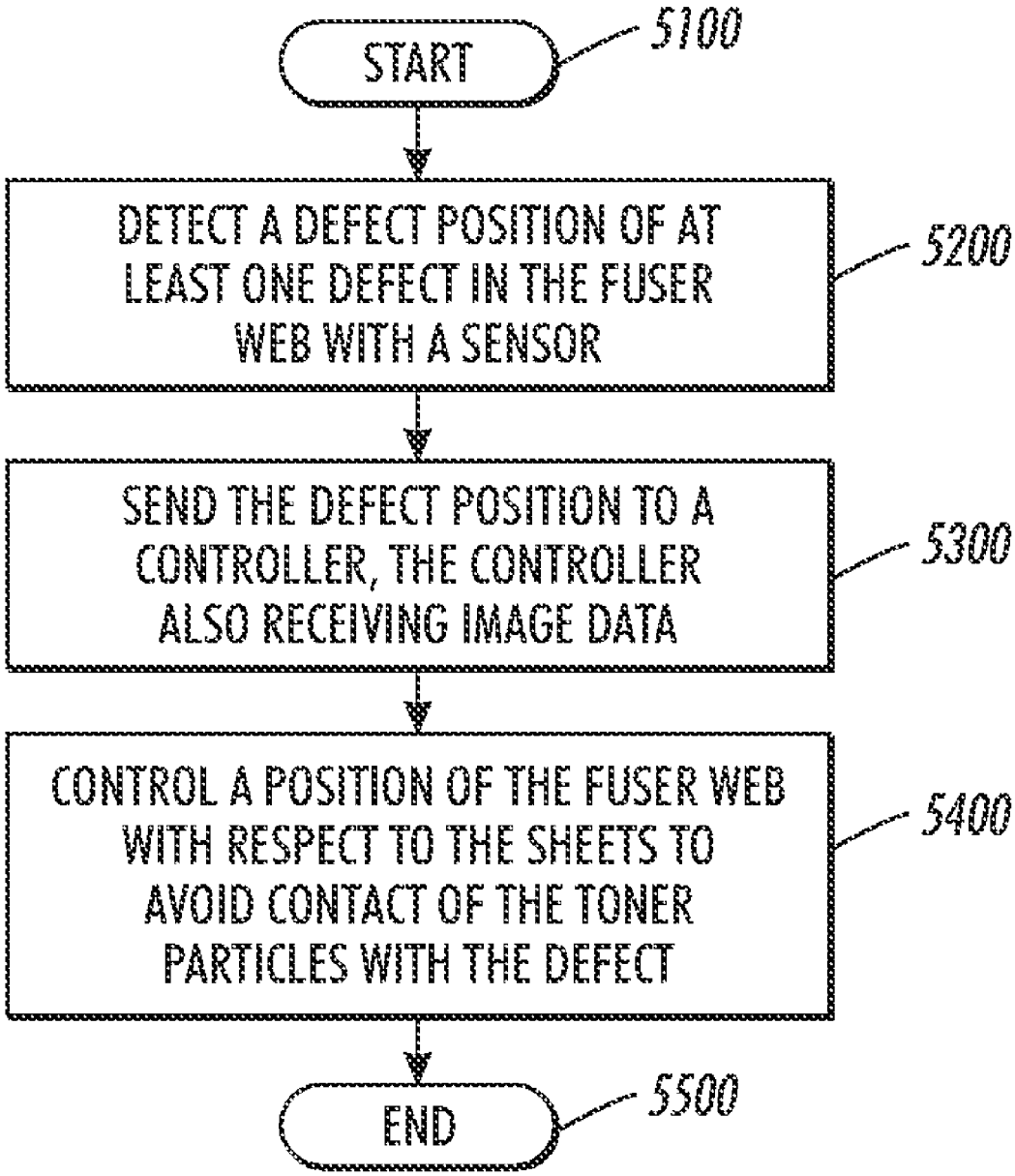
FIG. 5 illustrates a flowchart of a method for forming images on sheets in an electrophotographic apparatus.

FIG. 5 illustrates a flowchart of a method for forming images on sheets in an electrophotographic apparatus. The method starts at 5100. At 5200, a defect position of at least one defect in the fuser web is detected with a sensor.

At 5300, the detected defect position is sent to a controller. The controller also receives image data for forming the images.

At 5400, the controller controls a position of the fuser web with respect to the sheets to avoid contact of the toner particles with the defect during fusing of the toner particles to the sheets. At 5500, the method ends.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of forming images on sheets in an electrophotographic apparatus, the electrophotographic apparatus having an fuser web for fusing toner particles to the sheets to form the images, comprising:

detecting a defect position of at least one defect in the fuser web with a sensor;

sending the defect position to a controller, the controller also receiving image data for forming the images on the sheets; and controlling a position of the fuser web with respect to the sheets with the controller so that the defects avoid coming into contact with the toner particles on the sheets during fusing of the toner particles to the sheets contacting the fuser web using a fuser roller at a fusing location, the web fuser having a first end and a second end, wherein the first end of the fuser web is attached to a first web roller and the second end of the fuser web is attached to a second web roller.

2. The method of claim 1, wherein controlling a position of the fuser web with respect to the sheets comprises controlling the position of the at least one defect to be between adjacent ones of the sheets as the adjacent sheets are brought into contact with the fuser web.

3. The method of claim 1, wherein controlling a position of the fuser web with respect to the sheets comprises:

determining positioning of toner particles to be fused to each of the sheets to form the images from image data received by the controller, the images formed on each of the sheets comprising image areas where toner particles are fused and non-image areas where toner particles are not fused; and controlling the position of the at least one defect to be in non-image areas of the images on the sheets as the sheets are brought into contact with the fuser web.

4. The method of claim 1, wherein controlling a position of the fuser web with respect to the sheets comprises:

determining positioning of toner particles to be fused to each of the sheets to form the images from image data received by the controller, the images formed on each of the sheets comprising image areas where toner particles are fused and non-image areas where toner particles are not fused; and controlling the position of the at least one defect to be between adjacent ones of the sheets as the adjacent sheets are brought into contact with the fuser web or to be in non-image areas of the images on the sheets as the sheets are brought into contact with the fuser web.

5. The method of claim 1, wherein the at least one defect comprises a plurality of defects, and controlling a position of the fuser web with respect to the sheets comprises:

determining positioning of toner particles to be fused to each of the sheets to form the images from image data received by the controller, the images formed on each of the sheets comprising image areas where toner particles are fused and non-image areas where toner particles are not fused; and controlling the position of a first one of the plurality of defects to be between adjacent ones of the sheets as the adjacent sheets are brought into contact with the fuser web and controlling the position of a second one of the plurality of defects to be in non-image areas of the images on the sheets as the sheets are brought into contact with the fuser web.

6. An electrophotographic apparatus for forming images on sheets, comprising:

a fuser web for fusing toner particles to the sheets to form the images;

a sensor for detecting a defect position of at least one defect in the fuser web; and a controller that receives the defect position of the at least one defect on the fuser web from the sensor, wherein the controller positions the fuser web relative to the sheets to avoid the at least one defect from coming into contact with the toner on the sheets during fusing of the toner particles to the sheets;

a fuser roller which contacts the fuser web at a fusing location, the web fuser having a first end and a second end; and first and second web rollers, the first end of the fuser web being attached to the first web roller and the second end of the fuser web being attached to the second web roller.

7. The electrophotographic apparatus of claim 6, wherein the controller controls a position of the fuser web with respect to the sheets by controlling the position of the at least one defect to be between adjacent ones of the sheets as the adjacent sheets are brought into contact with the fuser web.

8. The electrophotographic apparatus of claim 6, wherein the controller controls a position of the fuser web with respect to the sheets by:

determining positioning of toner particles to be fused to each of the sheets to form the images from image data received by the controller, the images formed on each of the sheets comprising image areas where toner particles are fused and non-image areas where toner particles are not fused; and controlling the position of the at least one defect to be in non-image areas of the images on the sheets as the sheets are brought into contact with the fuser web.

9. The electrophotographic apparatus of claim 6, wherein the controller controls a position of the fuser web with respect to the sheets by:

determining positioning of toner particles to be fused to each of the sheets to form the images from image data received by the controller, the images formed on each of the sheets comprising image areas where toner particles are fused and non-image areas where toner particles are not fused; and controlling the position of the at least one defect to be between adjacent ones of the sheets as the adjacent sheets are brought into contact with the fuser web or to be in non-image areas of the images on the sheets as the sheets are brought into contact with the fuser web.

10. The electrophotographic apparatus of claim 6, wherein the at least one defect comprises a plurality of defects, and the controller controls a position of the fuser web with respect to the sheets by:

determining positioning of toner particles to be fused to each of the sheets to form the images from image data received by the controller, the images formed on each of the sheets comprising image areas where toner particles are fused and non-image areas where toner particles are not fused; and controlling the position of a first one of the plurality of defects to be between adjacent ones of the sheets as the adjacent sheets are brought into contact with the fuser web and controlling the position of a second one of the plurality of defects to be in non-image areas of the images on the sheets as the sheets are brought into contact with the fuser web.

11. The electrophotographic apparatus of claim 6, wherein the fuser web unwinds from the first web roller and winds onto the second web roller during the fusing process.

12. The electrophotographic apparatus of claim 11, wherein the fuser roller, fuser web, first web roller and second web roller are contained within a cassette.

13. The electrophotographic apparatus of claim 12, wherein the cassette is configured to be flipped over such that the first web roller will be positioned where the second web roller was positioned and the second web roller is positioned where the first web roller was positioned prior to flipping over the cassette.

14. The electrophotographic apparatus of claim 11, wherein the fuser web rewinds from the second web roller to the first web roller.

15. An electrophotographic apparatus for forming images on sheets, comprising:

a web fuser for fusing toner particles to the sheets to form the images;

a sensor for detecting a defect position of at least one defect in the web fuser;

a fuser roller which contacts the web fuser at a fusing location;

first and second web rollers, the first end of the fuser web being attached to the first web roller and the second end of the fuser web being attached to the second web roller; and a controller that receives the defect position of the at least one defect on the fuser web from the sensor, wherein the controller controls a position of the fuser web relative to the sheets to avoid the at least one defect from coming into contact with the toner on the sheets during fusing of the toner particles to the sheets by:

determining positioning of toner particles to be fused to each of the sheets to form the images from image data received by the controller, the images formed on each of the sheets comprising image areas where toner particles are fused and non-image areas where toner particles are not fused; and controlling the position of the at least one defect to be between adjacent ones of the sheets as the adjacent sheets are brought into contact with the web fuser or to be in non-image areas of the images on the sheets as the sheets are brought into contact with the web fuser.

16. The electrophotographic apparatus of claim 13, wherein the at least one defect comprises a plurality of defects, and the controller controls a position of the web fuser with respect to the sheets by:

controlling the position of a first one of the plurality of defects to be between adjacent ones of the sheets as the adjacent sheets are brought into contact with the web fuser and controlling the position of a second one of the plurality of defects to be in non-image areas of the images on the sheets as the sheets are brought into contact with the web fuser.

17. The electrophotographic apparatus of claim 15, wherein the fuser roller, fuser web, first web roller and second web roller are contained within a cassette.

18. The electrophotographic apparatus of claim 13, wherein the fuser web unwinds from the first web roller and winds onto the second web roller during the fusing process.

19. The electrophotographic apparatus of claim 18, wherein the cassette has a first opening on a first side and a second opening on a second side, wherein the first opening and the second opening are a same size and in corresponding positions.

20. The electrophotographic apparatus of claim 19, wherein the cassette is configured to be flipped over such that the first web roller will be positioned where the second web roller was positioned and the second web roller is positioned where the first web roller was positioned prior to flipping over the cassette.

* * * * *